US012466627B2

(12) United States Patent
Kitipongpatana et al.

(10) Patent No.: US 12,466,627 B2
(45) Date of Patent: Nov. 11, 2025

(54) HANDLE CLIP WITH CREEP PREVENTION FEATURES FOR SECURING AN APPLIANCE HANDLE IN TRANSPORT

(71) Applicant: Haier US Appliance Solutions, Inc., Wilmington, DE (US)

(72) Inventors: Pirapat Kitipongpatana, Louisville, KY (US); Aldo Vincent Kremmel, Palmyra, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 148 days.

(21) Appl. No.: 18/508,660

(22) Filed: Nov. 14, 2023

(65) Prior Publication Data

US 2025/0153917 A1 May 15, 2025

(51) Int. Cl.

| | |
|---|---|
| ***B65D 81/05*** | (2006.01) |
| ***A47L 15/42*** | (2006.01) |
| ***B65D 85/68*** | (2006.01) |

(52) U.S. Cl.

CPC ..... *B65D 81/05* (2013.01); *A47L 15/4268* (2013.01); *B65D 85/68* (2013.01); *B65D 2585/6815* (2013.01)

(58) Field of Classification Search

None

See application file for complete search history.

(56) References Cited

U.S. PATENT DOCUMENTS 3,883,972 A * 5/1975 Propst ..... G09F 7/18 40/617
2025/0176793 A1* 6/2025 Brewer ..... A47L 15/4268

FOREIGN PATENT DOCUMENTS

CN 114847835 A * 8/2022 ..... A47L 15/4257
CN 217712096 U 11/2022
KR 101330839 B1 11/2013

* cited by examiner

*Primary Examiner* — Kimberly T Wood

(74) *Attorney, Agent, or Firm* — Dority & Manning, P.A.

(57) ABSTRACT

A handle clip for securing an appliance handle during shipping may include a mount segment securable to the appliance handle. The handle clip may also include a support segment that may extend from the mount segment away from the appliance handle. The handle clip may further include a connection segment joined to the support segment for receipt on a wire frame. The connection segment may include a rigid tab. The rigid tab may include a rigid body, a groove shelf, and a gusset. The connection segment may also include a clamp tab. The clamp tab may include a clamp body and a forked lower groove wall. The connection segment may further include a resilient arc joint that may extend from the rigid tab to the clamp tab. The connection segment may define a wire groove to receive the wire frame between the rigid tab and the clamp tab.

19 Claims, 8 Drawing Sheets

HANDLE CLIP WITH CREEP PREVENTION FEATURES FOR SECURING AN APPLIANCE HANDLE IN TRANSPORT

FIELD OF THE DISCLOSURE

The present subject matter relates generally to a domestic appliance, such as dishwashing appliances, and more particularly to a handle transport structure for a domestic appliance.

BACKGROUND OF THE DISCLOSURE

Domestic appliances (e.g., dishwashing appliances, refrigerator appliances, oven appliances, etc.) are available in a variety of configurations. However, a common element of many domestic appliances is a door that is movably (e.g., rotatably) mounted to a cabinet or housing. In order to allow a user to open and close the door, a handle is often provided. In the case of dishwashing appliances, handles can generally be divided into two types: exposed handles and hidden handles. For exposed handles, they can be independently placed on the door and connected to the same.

Existing dishwashing appliances are generally shipped as a whole after being assembled. For dishwashers with exposed handles, different product packaging is often caused by the different structural dimensions of the handles. Multiple packaging methods are often needed, which can increase the development cycle, difficulty of manufacturing, or the cost of packaging design. In addition, the handle may be exposed, occupying a large space, and the packaging box required for packaging and transportation is large. Moreover, the handle may be easily damaged during transport.

Some dishwashing appliances have begun being sold or transported with a detachable handle, which can be packed in a box as an accessory during transportation. A consumer or retailer can then mount the handle once the dishwashing appliance has reached its final destination or is otherwise unpacked. Unfortunately, this can still present some challenges. In particular, it can still be easy for the handle to be damaged in transport. If the handle is simply placed within the dishwashing appliance, there is a chance that the interior of the dishwashing appliance may be damaged.

As a result, it would be useful to provide an assembly or appliance addressing one or more of the above issues. For instance, it may be advantageous to provide an assembly capable of safely securing a handle (e.g., apart from an appliance door) during transport.

BRIEF DESCRIPTION OF THE DISCLOSURE

Aspects and advantages of the invention will be set forth in part in the following description, or may be obvious from the description, or may be learned through practice of the invention.

In one exemplary aspect of the present disclosure, a handle clip is provided. The handle clip may secure an appliance handle during shipping. The handle clip may include a mount segment securable to the appliance handle. The handle clip may also include a support segment that may extend from the mount segment away from the appliance handle. The handle clip may further include a connection segment joined to the support segment for receipt on a wire frame. The connection segment may include a rigid tab. The rigid tab may include a rigid body, a groove shelf, and a gusset. The rigid body may extend downward relative to the support segment. The groove shelf may extend from the rigid body away from the support segment. The gusset may be provided between the rigid body and the groove shelf. The connection segment may also include a clamp tab longitudinally spaced apart from the rigid tab. The clamp tab may include a clamp body and a forked lower groove wall. The clamp body may extend downward relative to the support segment. The forked lower groove wall may extend from the clamp body toward the rigid tab. The connection segment may further include a resilient arc joint that may extend from the rigid tab to the clamp tab. The clamp tab may define a receiving slot to receive the gusset therethrough. The clamp tab may be selectively deflectable relative to the rigid tab. The connection segment may define a wire groove to receive the wire frame between the rigid tab and the clamp tab.

In another exemplary aspect of the present disclosure a handle clip is provided. The handle clip may secure an appliance handle during shipping. The handle clip may include a mount segment securable to the appliance handle. The handle clip may also include a support segment that may extend from the mount segment away from the appliance handle. The handle clip may further include a connection segment joined to the support segment for receipt on a wire frame. The connection segment may include a rigid tab. The rigid tab may include a rigid body, a groove shelf, and a gusset. The rigid body may extend downward relative to the support segment. The groove shelf may extend from the rigid body away from the support segment. The gusset may be provided between the rigid body and the groove shelf. The connection segment may also include a clamp tab longitudinally spaced apart from the rigid tab. The clamp tab may include a clamp body and a forked lower groove wall. The clamp body may extend downward relative to the support segment. The forked lower groove wall may extend from the clamp body toward the rigid tab. The connection segment may further include a resilient arc joint extended from the rigid tab to the clamp tab. The connection segment may define a wire groove to receive the wire frame between the rigid tab and the clamp tab.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
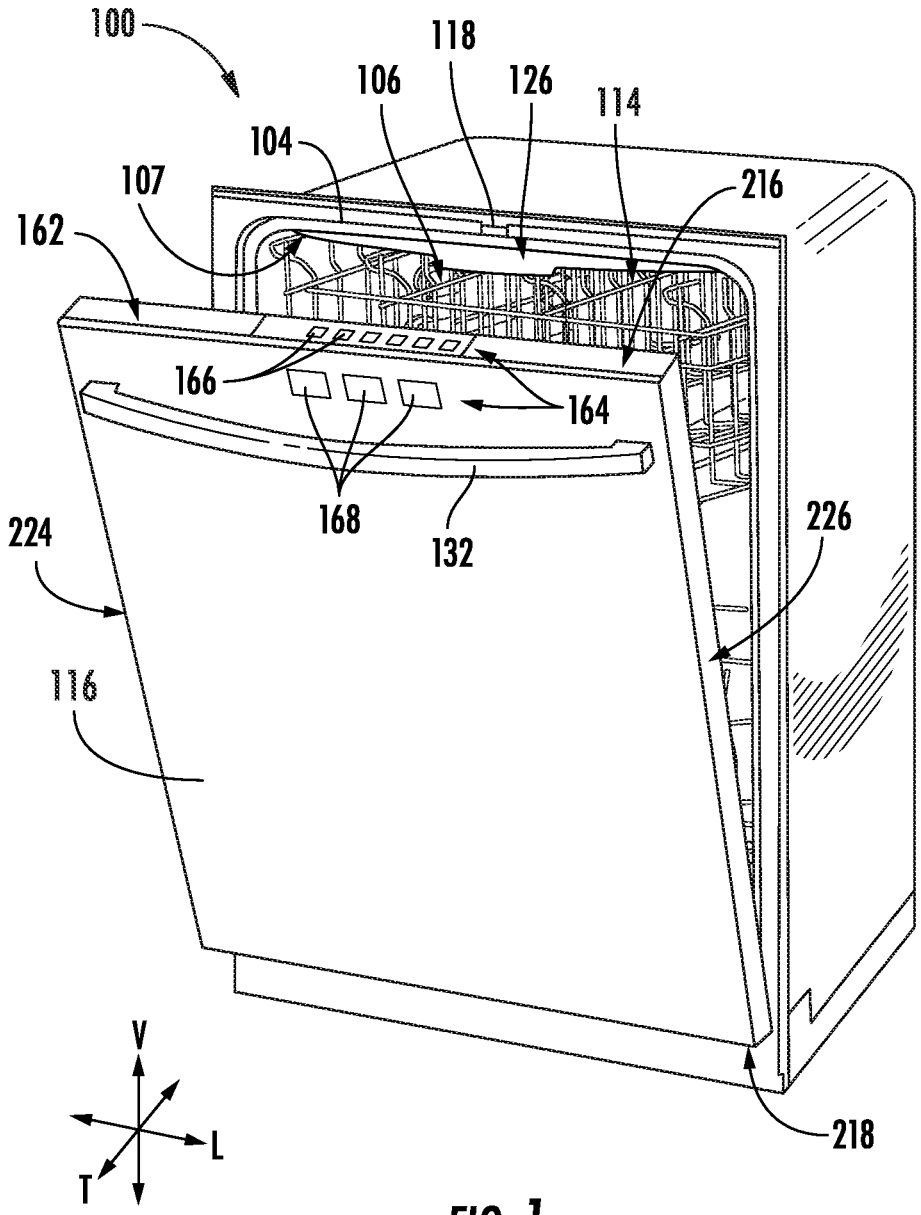
FIG. 1 provides a perspective view of a dishwashing appliance, including a dishwasher door according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents. The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as, clockwise or counterclockwise, with the vertical direction V).

Figure 2:
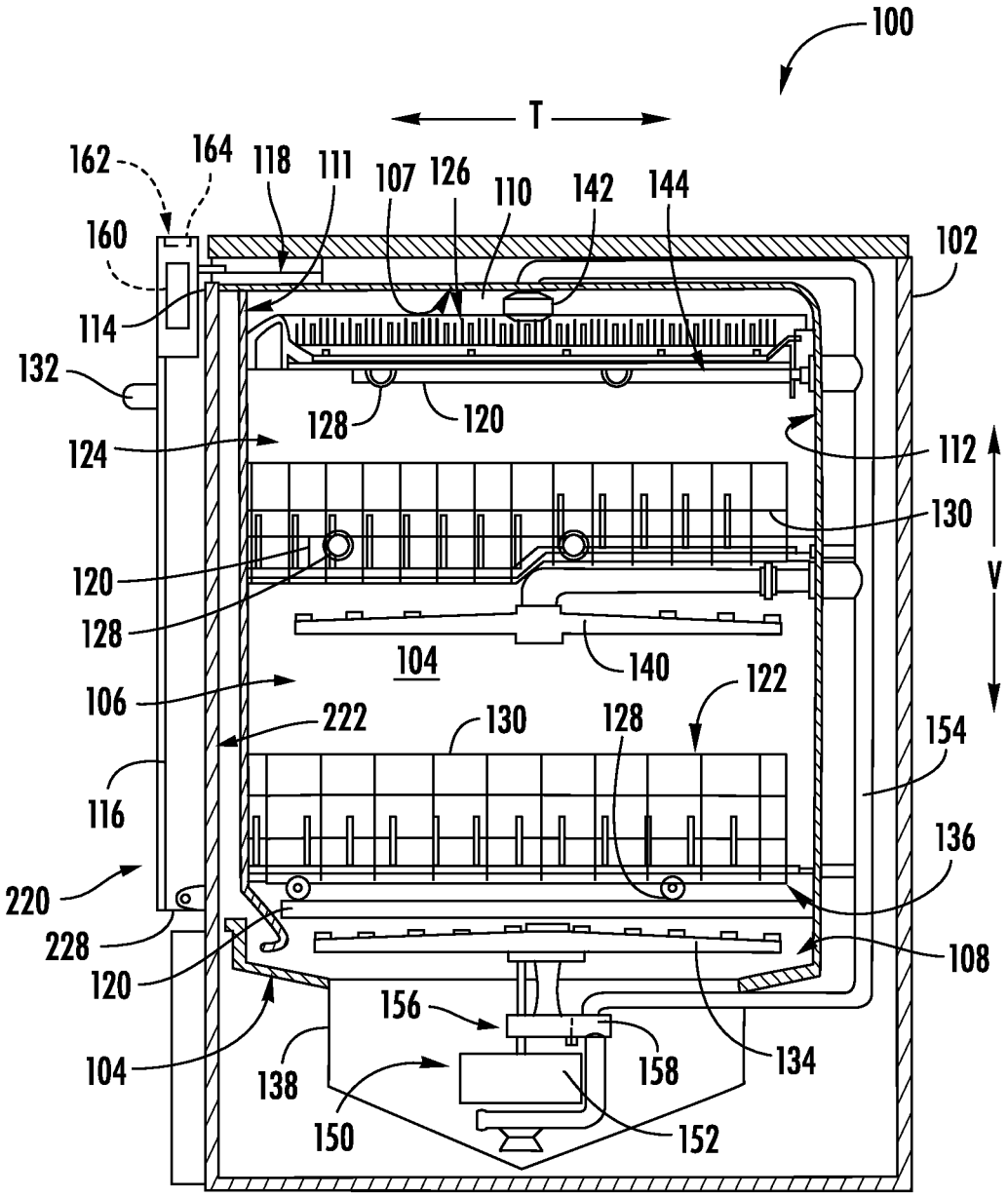
FIG. 2 provides a cross-sectional elevation view of the exemplary dishwashing appliance of FIG. 1.

FIGS. 1 and 2 depict an exemplary domestic dishwasher or dishwashing appliance 100 that may be configured in accordance with aspects of the present disclosure. For the particular embodiment of FIGS. 1 and 2, the dishwasher 100 includes a cabinet 102 having a tub 104 therein that defines a wash chamber 106. As shown, tub 104 extends between a top 107 and a bottom 108 along a vertical direction V, between a pair of side walls 110 along a lateral direction L, and between a front side 111 and a rear side 112 along a transverse direction T. Each of the vertical direction V, lateral direction L, and transverse direction T are mutually orthogonal to one another.

The tub 104 includes a front opening 114 and a door 116 hinged at its bottom for movement between a normally closed vertical position (shown in FIG. 2), wherein the wash chamber 106 is sealed shut for washing operation, and a horizontal open position for loading and unloading of articles from the dishwasher 100. In the normally closed position, door 116 extends from a top end 216 to a bottom end 218 along the vertical direction V; from a front end 220 to a rear end 222 along the transverse direction T; and between two lateral ends 224, 226 along the lateral direction L. A pivot axis 228 may be defined on the door 214 (e.g., by one or more lateral pivot hinges or pins), for example, parallel to the lateral direction L at or proximal to bottom end 218. A handle 132 may be provided (e.g., proximal to top end 216. According to exemplary embodiments, dishwasher 100 further includes a door closure mechanism or assembly 118 that is used to lock and unlock door 116 for accessing and sealing wash chamber 106.

As illustrated in FIG. 2, tub side walls 110 may accommodate a plurality of rack assemblies. More specifically, guide rails 120 may be mounted to side walls 110 for supporting a lower rack assembly 122, a middle rack assembly 124, and an upper rack assembly 126. As illustrated, upper rack assembly 126 is positioned at a top portion of wash chamber 106 above middle rack assembly 124, which is positioned above lower rack assembly 122 along the vertical direction V. Each rack assembly 122, 124, 126 is adapted for movement between an extended loading position (not shown) in which the rack is substantially positioned outside the wash chamber 106, and a retracted position (shown in FIGS. 1 and 2) in which the rack is located inside the wash chamber 106. This is facilitated, for example, by rollers 128 mounted onto rack assemblies 122, 124, 126, respectively. Although a guide rails 120 and rollers 128 are illustrated herein as facilitating movement of the respective rack assemblies 122, 124, 126, it should be appreciated that any suitable sliding mechanism or member may be used according to alternative embodiments.

Some or all of the rack assemblies 122, 124, 126 are fabricated into lattice structures including a plurality of wires or elongated members 130 (for clarity of illustration, not all elongated members making up rack assemblies 122, 124, 126 are shown in FIG. 2). In this regard, rack assemblies 122, 124, 126 are generally configured for supporting articles within wash chamber 106 while allowing a flow of wash fluid to reach and impinge on those articles (e.g., during a cleaning or rinsing cycle). According to another exemplary embodiment, a silverware basket (not shown) may be removably attached to a rack assembly (e.g., lower rack assembly 122) for placement of silverware, utensils, and the like, that are otherwise too small to be accommodated by rack 122.

Dishwasher 100 further includes a plurality of spray assemblies for urging a flow of water or wash fluid onto the articles placed within wash chamber 106. More specifically, as illustrated in FIG. 2, dishwasher 100 includes a lower spray arm assembly 134 disposed in a lower region 136 of wash chamber 106 and above a sump 138 so as to rotate in relatively close proximity to lower rack assembly 122. Similarly, a mid-level spray arm assembly 140 is located in an upper region of wash chamber 106 and may be located below and in close proximity to middle rack assembly 124. In this regard, mid-level spray arm assembly 140 may generally be configured for urging a flow of wash fluid up through middle rack assembly 124 and upper rack assembly 126. Additionally, an upper spray assembly 142 may be located above upper rack assembly 126 along the vertical direction V. In this manner, upper spray assembly 142 may be configured for urging or cascading a flow of wash fluid downward over rack assemblies 122, 124, and 126. As further illustrated in FIG. 2, upper rack assembly 126 may further define an integral spray manifold 144, which is generally configured for urging a flow of wash fluid substantially upward along the vertical direction V through upper rack assembly 126.

The various spray assemblies and manifolds described herein may be part of a fluid distribution system or fluid circulation assembly 150 for circulating water and wash fluid in the tub 104. More specifically, fluid circulation assembly 150 includes a pump 152 for circulating water or wash fluid (e.g., detergent, water, or rinse aid) in the tub 104. Pump 152 may be located within sump 138 or within a machinery compartment located below sump 138 of tub 104, as generally recognized in the art. Fluid circulation assembly 150 may include one or more fluid conduits or circulation piping for directing water or wash fluid from pump 152 to the various spray assemblies and manifolds. For example, as illustrated in FIG. 2, a primary supply conduit 154 may extend from pump 152, along rear 112 of tub 104 along the vertical direction V to supply wash fluid throughout wash chamber 106.

As illustrated, primary supply conduit 154 is used to supply wash fluid to one or more spray assemblies (e.g., to mid-level spray arm assembly 140 and upper spray assembly 142). However, it should be appreciated that according to alternative embodiments, any other suitable plumbing configuration may be used to supply wash fluid throughout the various spray manifolds and assemblies described herein. For example, according to another exemplary embodiment, primary supply conduit 154 could be used to provide wash fluid to mid-level spray arm assembly 140 and a dedicated secondary supply conduit (not shown) could be utilized to provide wash fluid to upper spray assembly 142. Other plumbing configurations may be used for providing wash fluid to the various spray devices and manifolds at any location within dishwasher appliance 100.

Each spray arm assembly 134, 140, 142, integral spray manifold 144, or other spray device may include an arrangement of discharge ports or orifices for directing wash fluid received from pump 152 onto dishes or other articles located in wash chamber 106. The arrangement of the discharge ports, also referred to as jets, apertures, or orifices, may provide a rotational force by virtue of wash fluid flowing through the discharge ports. Alternatively, spray arm assemblies 134, 140, 142 may be motor-driven, or may operate using any other suitable drive mechanism. Spray manifolds and assemblies may also be stationary. The resultant movement of the spray arm assemblies 134, 140, 142 and the spray from fixed manifolds provides coverage of dishes and other dishwasher contents with a washing spray. Other configurations of spray assemblies may be used as well. For example, dishwasher 100 may have additional spray assemblies for cleaning silverware, for scouring casserole dishes, for spraying pots and pans, for cleaning bottles, etc. One skilled in the art will appreciate that the embodiments discussed herein are used for the purpose of explanation only and are not limitations of the present subject matter.

In operation, pump 152 draws wash fluid in from sump 138 and pumps it to a diverter assembly 156 (e.g., which may be positioned within sump 138 of dishwasher appliance 100). Diverter assembly 156 may include a diverter disk (not shown) disposed within a diverter chamber 158 for selectively distributing the wash fluid to the spray arm assemblies 134, 140, 142 or other spray manifolds or devices. For example, the diverter disk may have a plurality of apertures that are configured to align with one or more outlet ports (not shown) at the top of diverter chamber 158. In this manner, the diverter disk may be selectively rotated to provide wash fluid to the desired spray device.

According to an exemplary embodiment, diverter assembly 156 is configured for selectively distributing the flow of wash fluid from pump 152 to various fluid supply conduits, only some of which are illustrated in FIG. 2 for clarity. More specifically, diverter assembly 156 may include four outlet ports (not shown) for supplying wash fluid to a first conduit for rotating lower spray arm assembly 134 in the clockwise direction, a second conduit for rotating lower spray arm assembly 134 in the counter-clockwise direction, a third conduit for spraying an auxiliary rack such as the silverware rack, and a fourth conduit for supply mid-level or upper spray assemblies 140, 142 (e.g., such as primary supply conduit 154).

The dishwasher 100 is further equipped with a controller 160 to regulate operation of the dishwasher 100. The controller 160 may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 160 may be constructed without using a microprocessor (e.g., using a combination of discrete analog or digital logic circuitry, such as switches, amplifiers, integrators, comparators, flip-flops, AND gates, and the like) to perform control functionality instead of relying upon software.

The controller 160 may be positioned in a variety of locations throughout dishwasher 100. In the illustrated embodiment, the controller 160 may be located within a control panel area 162 of door 116, as shown in FIGS. 1 and 2. In such an embodiment, input/output ("I/O") signals may be routed between the control system and various operational components of dishwasher 100 along wiring harnesses that may be routed through the bottom of door 116. Typically, the controller 160 includes a user interface panel 164 through which a user may select various operational features and modes and monitor progress of the dishwasher 100. In one embodiment, the user interface 164 may represent a general purpose I/O ("GPIO") device or functional block. In certain embodiments, the user interface 164 includes input components 166, such as one or more of a variety of electrical, mechanical or electro-mechanical input devices including rotary dials, push buttons, and touch pads. As shown, one or more user inputs 166 (e.g., buttons) of user interface 164 may be positioned at a top end 216 of door 116 (e.g., on or through a top wall of door 116). The user interface 164 may further include one or more display components 168, such as a digital display device or one or more indicator light assemblies designed to provide operational feedback to a user. The user interface 164 may be in communication with the controller 160 via one or more signal lines or shared communication busses.

It should be appreciated that, except as otherwise specified, the present disclosure is not limited to any particular style, model, or configuration of appliance dishwasher 100. The exemplary embodiment depicted in FIGS. 1 and 2 is for illustrative purposes only.

Figure 3:
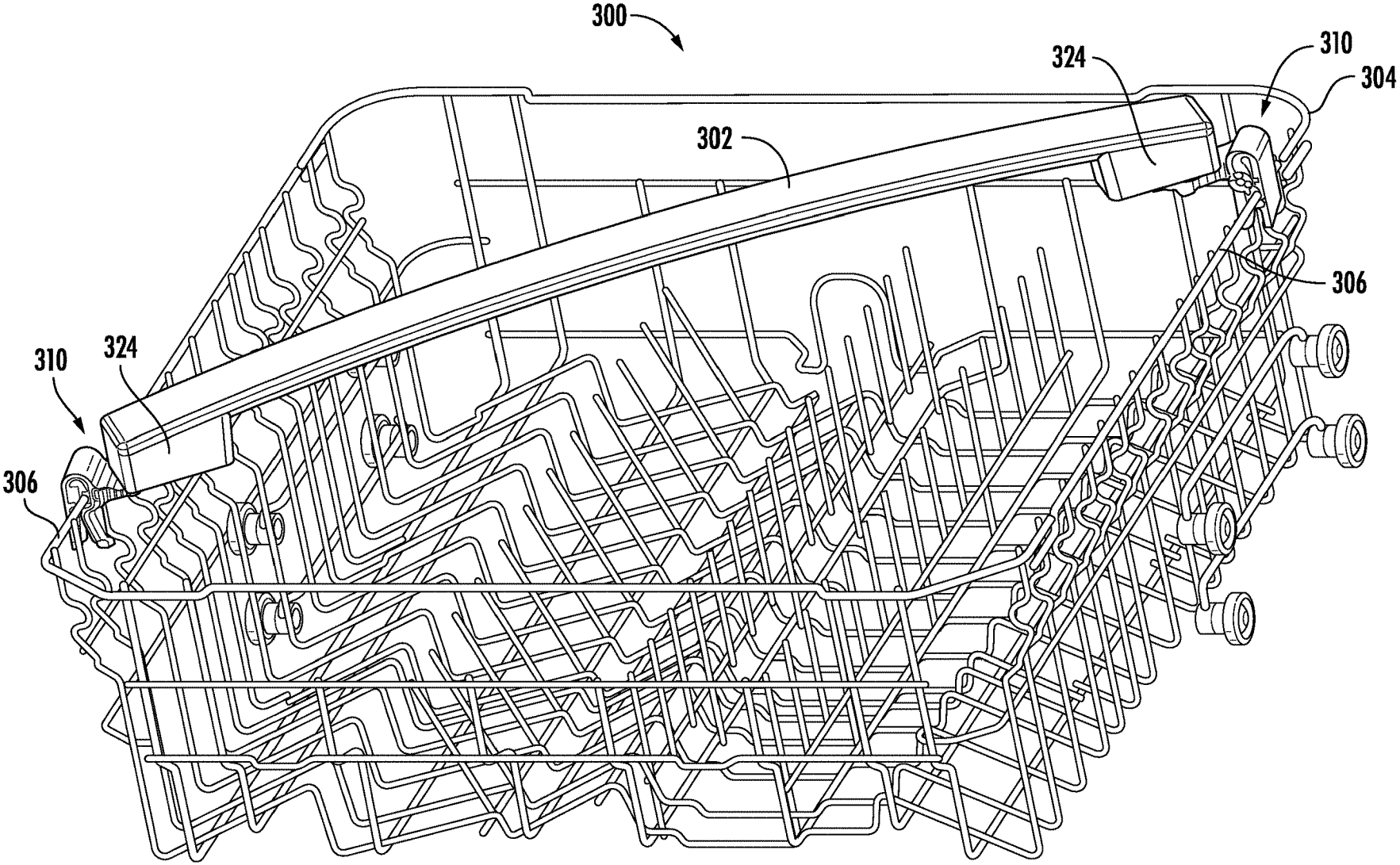
FIG. 3 provides a perspective view of an appliance handle and transport assembly according to exemplary embodiments of the present disclosure.
Figure 4:
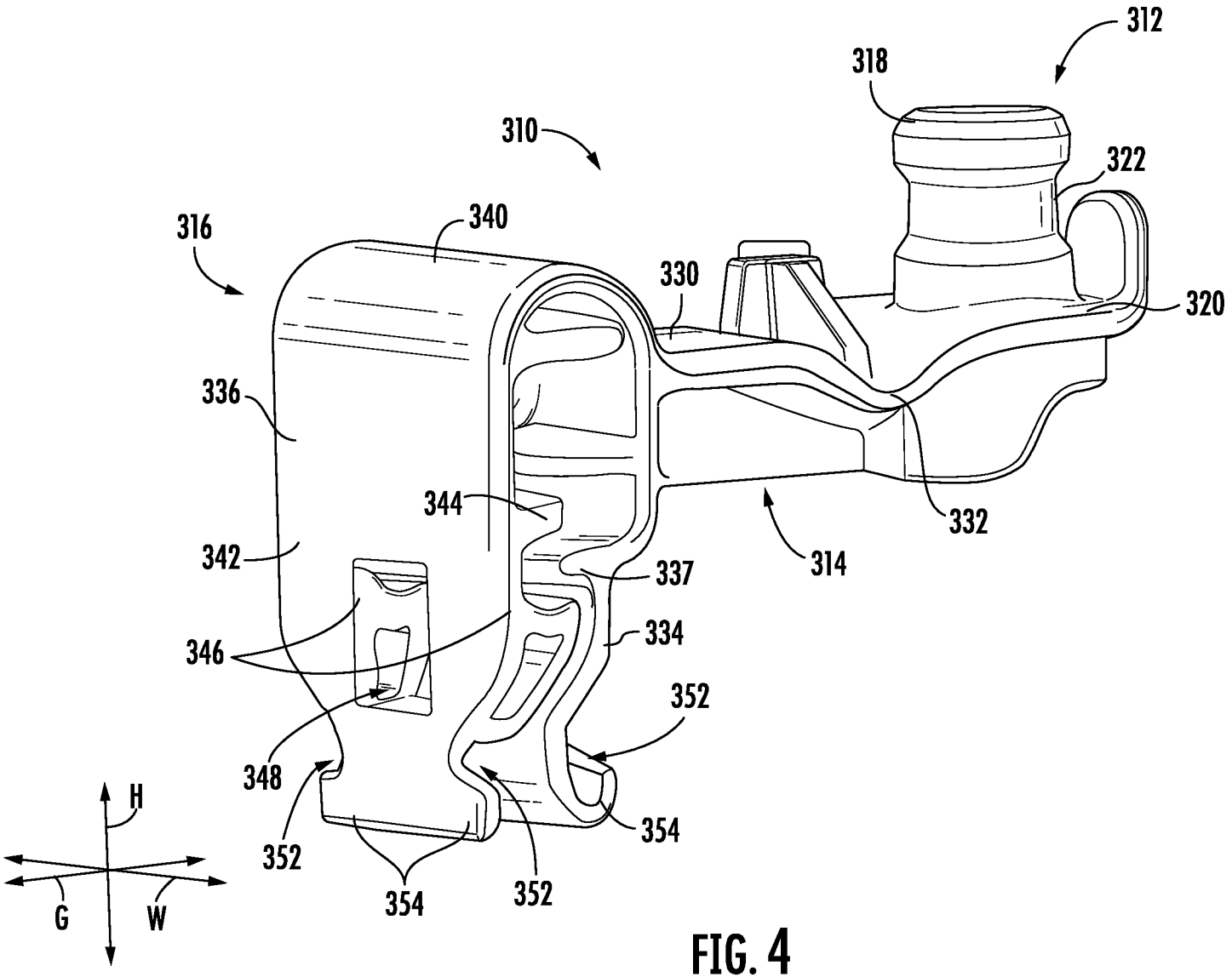
FIG. 4 provides a perspective view of a handle clip for transporting an appliance handle according to exemplary embodiments of the present disclosure.

Turning now generally to FIGS. 3 through 9, various views are provided of a transport assembly 300 according to exemplary embodiments of the disclosure. FIG. 3, in particular, illustrates an appliance handle 302 (e.g., handle 132) mounted in a transport state to a wire frame or rack 304 (e.g., rack assembly 126). As shown, one or more handle clips 310 may be attached to appliance handle 302 (e.g., at an end thereof). For instance, a pair of handle clips 310 may be provided at opposite ends of appliance handle 302. In a transport state, the handle clips 310 may be clamped and fixed on the wire rack 304 (e.g., within wash chamber 106-FIG. 2); appliance handle 302 may be located above the wire rack 304 (e.g., all or at least portion thereof).

In some embodiments, the size of the appliance handle 302 (e.g., in a lateral or left and right direction) is larger than the size of the wire rack 304 (e.g., in the lateral or left and right direction). Appliance handle 302 may be inclined forward or backward in the left and right direction. The wire rack 304 is formed by cross-connecting a plurality of rack bars 306, and the handle clip(s) 310 may be clamped on a rack bar 306, such as at the upper end of the rack 304.

Notably, in the transport state, the arrangement of the appliance handle 302 and transport assembly 300 may be beneficial to reduce the space occupied in a packaging box or prevent the damage of the appliance handle 302. Additionally or alternatively, packaging and difficulties caused by the same may be reduced.

Turning especially to FIGS. 4 through 7, various views are provided of a handle clip 310 (e.g., in isolation apart from appliance handle 302) according to exemplary embodiments of the present disclosure. Generally, the handle clip 310 is selectively movable relative to the rest of appliance 100 (FIG. 1) (e.g., during the assembly or packing process). Moreover, handle clip 310 defines a plurality of mutually orthogonal directions, including a longitudinal direction G, lateral or width direction W, and a height direction H. As shown, the handle clip 310 may further include multiple discrete segments (e.g., joined together as a continuous or unitary member). In some embodiments, the handle clip 310 includes a separate mount segment 312, support segment 314, and connection segment 316. As will be described in greater detail below, the mount segment 312 may be securable to the appliance handle 302 while the connection segment 316 can be attached or secured to a portion of a wire rack 304 (e.g., rack bar 306). Support segment 314 may generally extend between mount segment 312 and connection segment 316 (e.g., joined to the same).

As shown, mount segment 312 may include an assembly post 318. The assembly post 318 may extend, for instance, upward along the height direction H. In some embodiments, the assembly post 318 extends above (e.g., at a higher position relative to the height direction H than) the support segment 314 or at least a portion of the connection segment 316. Optionally, a base or platform 320 of the mount segment 312 may be provided proximal to the support segment 314 or opposite a free end of assembly post 318. Such a platform 320 may define a relatively enlarged width relative to the rest of assembly post 318. In certain embodiments, the assembly post 318 may include a general cylindrical shape or body. In some embodiments, the assembly post 318 defines a lock notch or groove 322 that extends (e.g., inward), such as at a middle or intermediate height position of assembly post 318 (e.g., to receive or engage with a mechanical fastener, such as a clamp, screw, or bolt).

When assembled, the assembly post 318 may be secured to or received within at least a portion of the appliance handle 302. For instance, turning further to FIGS. 8 and 9, the assembly post 318 may be matched to—and selectively received within—a mated cavity 328 defined by the appliance handle 302. Such a mated cavity 328 may be defined, for instance, by an endcap 324 of appliance handle 302. In some embodiments, the appliance handle 302 (e.g., at endcap 324) further defines a fastener hole 308 (e.g., threaded hole) extending at a non-parallel angle (e.g., relative to mated cavity 328 or assembly post 318) and through which the mechanical fastener may be received. The lock groove 322 may be aligned with the fastener hole and may be used to receive or engage with the mechanical post fastener. In turn, the engagement between the mechanical post fastener and assembly post 318 may prevent the assembly post 318 from being separated from the mated cavity 328. Optionally, the platform 320 can serve as a height limit for the mount segment 312 or assembly post 318 relative to the mated cavity 328.

Returning generally to FIGS. 3 through 7, a support segment 314 may extend from the mount segment 312 away from the appliance handle 302. In some embodiments, the support segment 314 includes a longitudinal arm 330 that extends generally along the longitudinal direction G. The longitudinal arm 330 may be, for instance, approximately perpendicular to the assembly post 318. Optionally, a concavely arranged arc-shaped portion 332 may be provided (e.g., between the mount segment 312 and the longitudinal arm 330 along the longitudinal direction G).

Opposite the mount segment 312 (e.g., relative to the longitudinal direction G), the connection segment 316 may be joined to the support segment 314 for receipt on the wire rack 304. As shown, connection segment 316 generally includes a rigid tab 334 and a clamp tab 336 that can together bound (e.g., longitudinally) a portion of the wire rack 304 (e.g., rack bar 306). Specifically, connection segment 316 may define a wire groove 338 to receive the wire rack 304 (e.g., rack bar 306) therein between the rigid tab 334 and clamp tab 336. Both the clamp tab 336 and the rigid tab 334 may extend in a generally downward orientation. For instance, the rigid tab 334 may extend downward (e.g., in the height direction H) from or relative to the support segment 314. Additionally or alternatively, the clamp tab 336 may extend downward (e.g., in the height direction H) while being apart (e.g., approximately along the longitudinal direction G) from the rigid tab 334.

Generally, the clamp tab 336 is selectively deflectable relative to the rigid tab 334. Thus, the clamp tab 336 may be deflected outward when receiving the rack bar 306 and returned inward (e.g., toward rigid tab 334) when rack bar 306 is either removed or received within wire groove 338. In some embodiments, a resilient arc joint 340 extends from the rigid tab 334 to the clamp tab 336. For instance, the resilient arc joint 340 may curve up and over from rigid tab 334 to clamp tab 336 opposite a free end of one or both of tabs 334, 336. Together, the clamp tab 336, the rigid tab 334, and the resilient arc joint 340 may form a U-shaped structure such that the resilient arc joint 340 may act as an elastic hinge to bias the clamp tab 336 and rigid tab 334.

Figure 5:
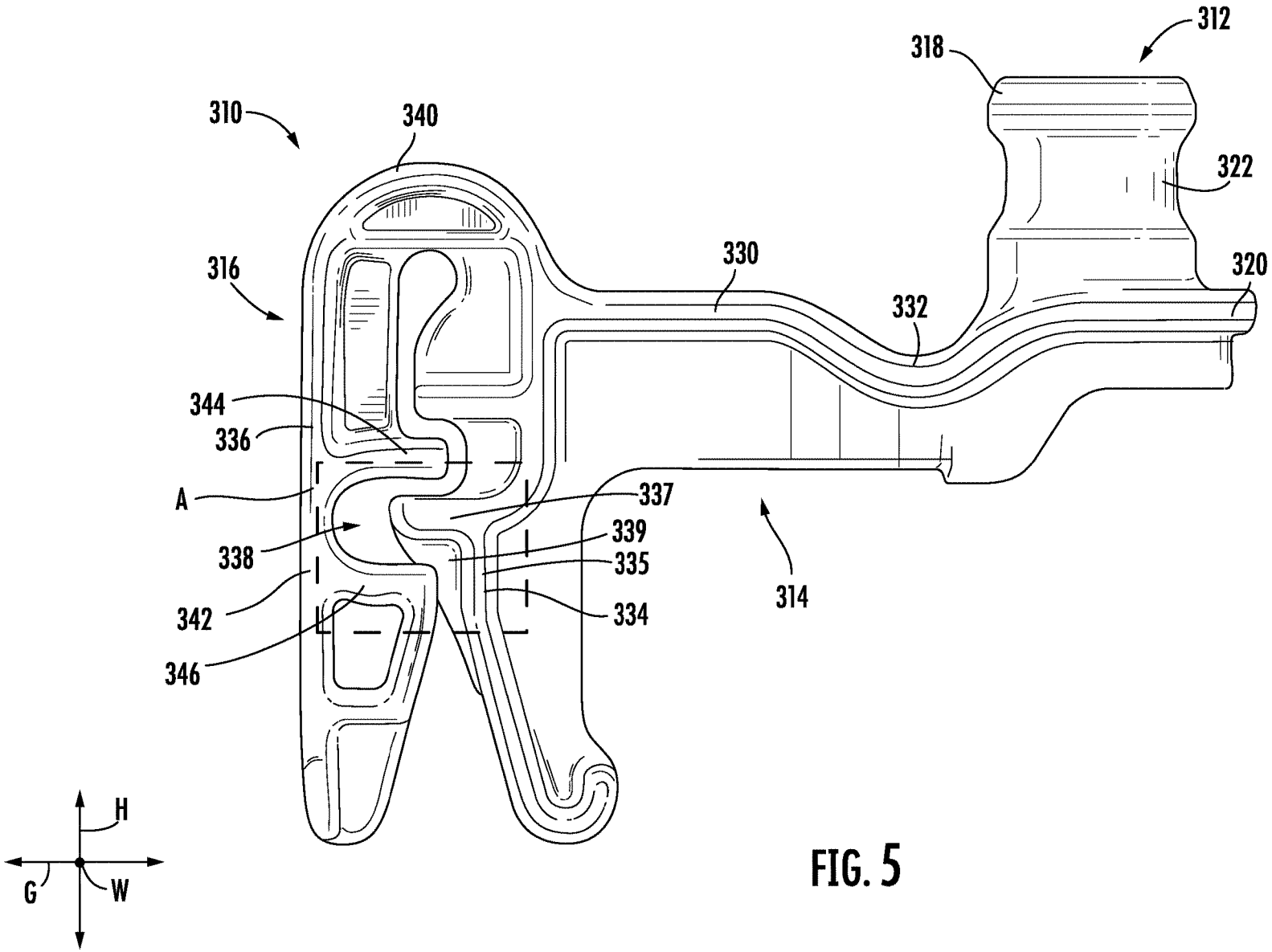
FIG. 5 provides a side elevation view of the exemplary handle clip of FIG. 4.
Figure 6:
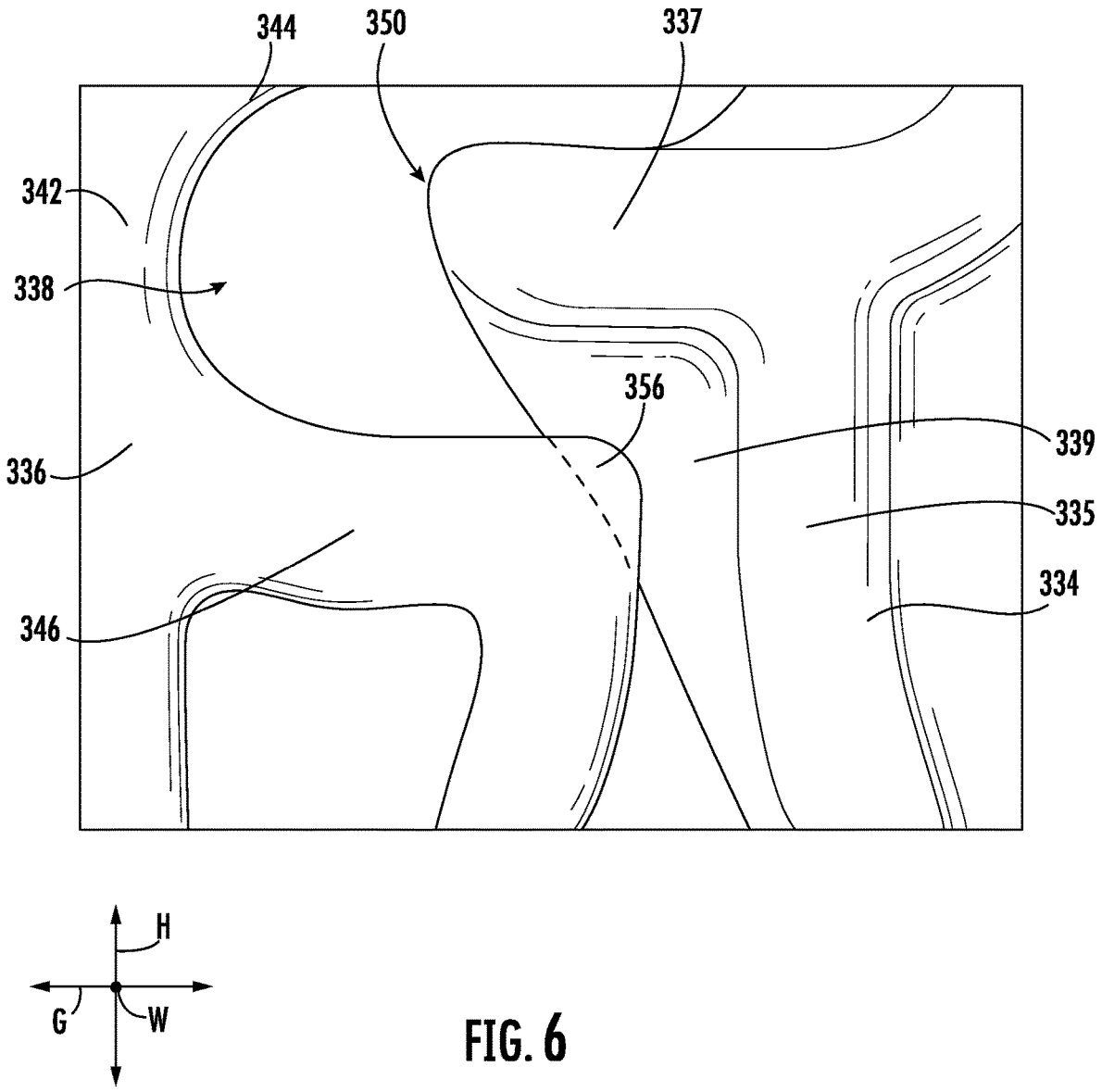
FIG. 6 provides a close-up view of a portion FIG. 5 taken from section A.
Figure 7:
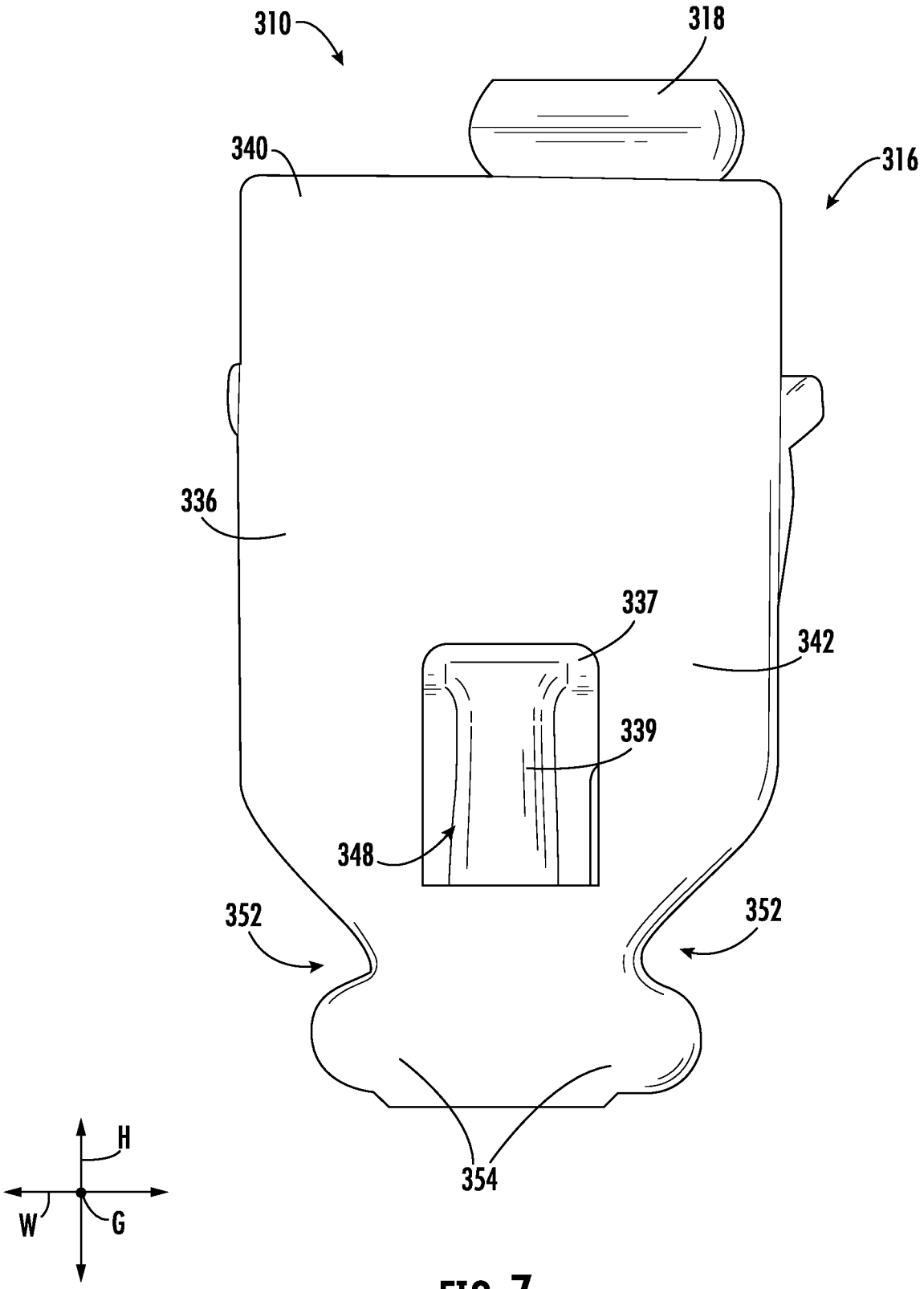
FIG. 7 provides a front elevation view of the exemplary handle clip of FIG. 4.
Figure 8:
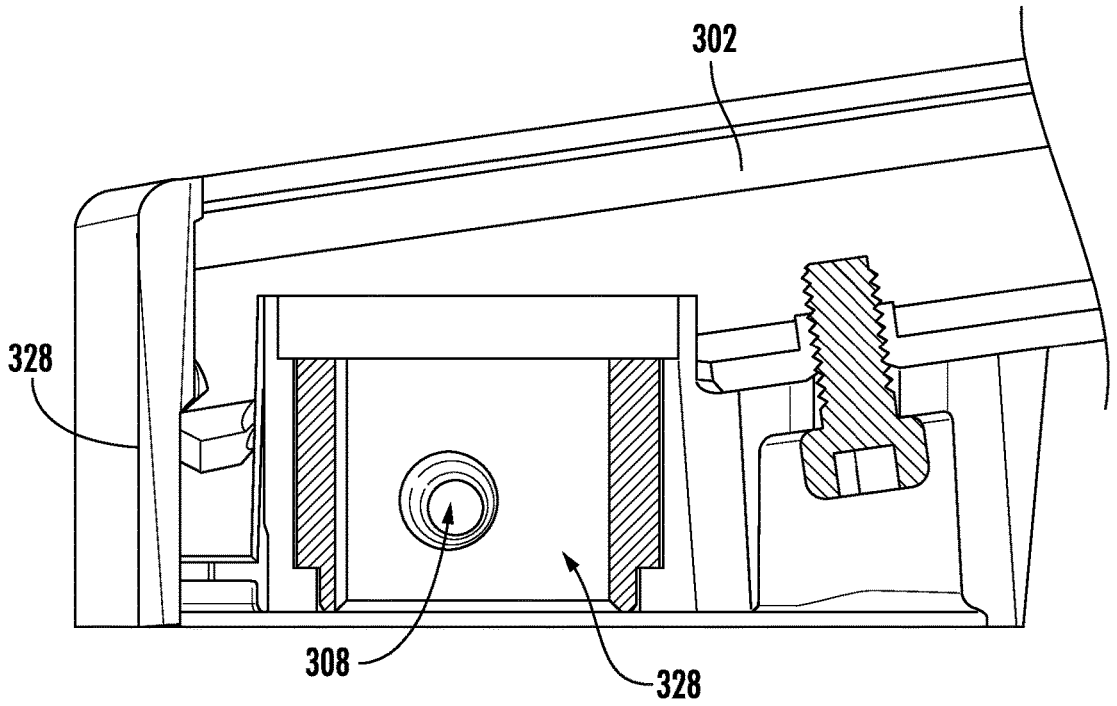
FIG. 8 provides a sectional view of a portion of a portion of an appliance handle according to exemplary embodiments of the present disclosure.
Figure 9:
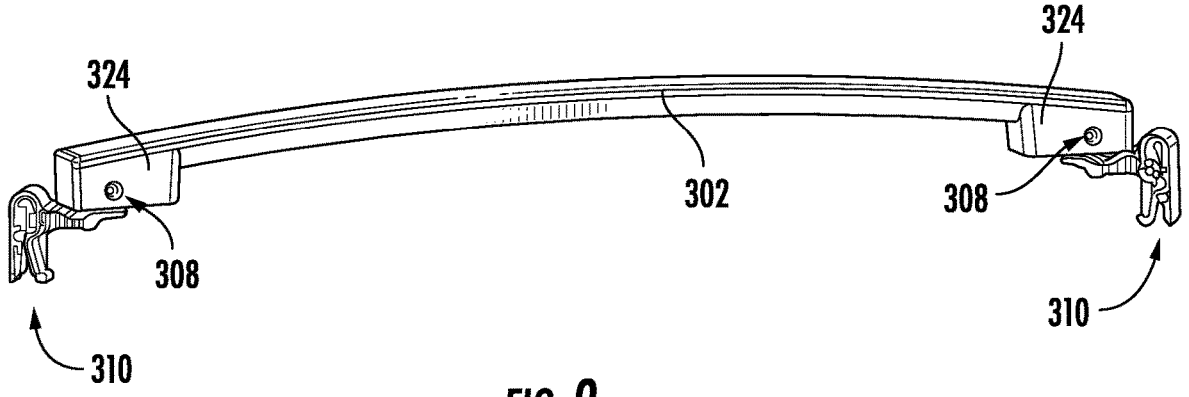
FIG. 9 provides a perspective view of an appliance handle and a pair of handle clips according to exemplary embodiments of the present disclosure.

As shown, the rigid tab 334 may include a rigid body 335, a groove shelf 337, and a gusset 339. In some embodiments, the rigid body 335 of the rigid tab 334 extends downward (e.g., in the height direction H) from or relative to the support segment 314. Additionally, the groove shelf 337 extends from the rigid body 335 away from the support segment 314 (e.g., approximately along the longitudinal direction G). The gusset 339 may be provided between the rigid body 335 and the groove shelf 337. Additionally, the gusset 339 may be extended toward the clamp tab 336 from the rigid body 335. For example, as illustrated in FIGS. 5 and 6, the gusset 339 may be a triangular shaped component that is extended, at least in part, toward the clamp tab, from the rigid body 335. In some embodiments (e.g., as illustrated in FIGS. 5 and 6), the gusset 339 is positioned at a center (e.g., approximately along the lateral direction W) of the rigid tab 334.

Alternatively, in some other exemplary embodiments, the gusset 339 may be positioned off-center (e.g., approximately along the lateral direction W) of the rigid tab 334. Further, in some other exemplary embodiments, the gusset 339 may be positioned at either lateral edge of the rigid tab 334.

Additionally, as shown, the clamp tab 336 may include a clamp body 342, an upper groove wall 344, and a forked lower groove wall 346. The clamp body 342 of the clamp tab 336 may extend downward (e.g., in the height direction H) relative to the support segment 314. The upper groove wall 344 may be disposed above the forked lower groove wall 346 and may extend toward the rigid tab 334. The upper groove wall 344 may, for instance, define an upper limit of the wire groove 338. Additionally, the forked lower groove wall 346 may extend from the clamp body 342 toward the rigid tab 334. In some embodiments, the clamp tab 336 defines a receiving slot 348 to receive the gusset 339 therethrough. More particularly, the clamp body 342 and the forked lower groove wall 346 may define the receiving slot 348. Separately from or in addition to the upper groove wall 344 and the forked lower groove wall 346, the groove shelf 337 may be disposed vertically (e.g., along the height direction H) between the upper groove wall 344 and the forked lower groove wall 346. A longitudinal end of the groove shelf 337 may define an end stop 350 for holding rack bar 306 within wire groove 338. In this regard, the upper groove wall 344, the forked lower groove wall 346, and the groove shelf 337 together may define the wire groove 338. Moreover, the groove shelf 337 may provide an interlocking surface with the upper groove wall 344 and the forked lower groove wall 346. For instance, the upper groove wall 344 and the forked lower groove wall 346 may each extend over at least a portion of groove shelf 337 and bound vertical movement of rack bar 306 within wire groove 338.

In certain embodiments, one or more lateral or catch notches 352 are defined at the free end of clamp tab 336 or rigid tab 334. Specifically, the catch notches 352 may be formed as laterally open cutouts (e.g., along the width direction W). As shown, a C-shaped void may be formed by the catch notch 352. The free or unencumbered ends of clamp tab 336 or rigid tab 334 may define one or more cutouts as catch notches 352 below the wire groove 338 or opposite of the resilient arc joint 340. As an example, the clamp tab 336 may define at least one catch notch 352 with one or more legs 354 spaced apart from each other (e.g., along the height direction H). Optionally, a pair of catch notches 352 may be defined such that the free end of clamp tab 336 forms a T-post. As an additional or alternative example, the rigid tab 334 may define at least one catch notch 352 with one or more legs 354 spaced apart from each other (e.g., along the height direction H). Optionally, a pair of catch notches 352 may be defined such that the free end of rigid tab 334 forms a T-post. In some such embodiments, the T-post of the rigid tab 334 may be vertically aligned (e.g., at the same position along the height direction H) with the T-post of the clamp tab 336.

In some instances, during the transport state of the domestic appliance, the handle clip may be exposed to various environmental conditions (e.g., within the domestic appliance). For example, during the transport state, a cavity (e.g., the tub 104) of the domestic appliance may experience elevated temperatures. In this regard, during the transport state, the handle clip 310 may be exposed to elevated temperatures. In some instances, this elevation in temperature may lead to a spontaneous release of internal stresses within the handle clip 310. Thus, during the transport state, the material properties, and the structural integrity of the handle clip 310 may potentially change. This change in the material properties and the structural integrity of the handle clip 310 (e.g., due to an elevated temperature) may herein be referred to as "thermal relaxation" of the handle clip 310.

Additionally or alternatively, during the transport state of the domestic appliance, the handle clip 310 may be exposed to various load conditions. For instance, the handle clip 310 may support the weight of the appliance handle 302 during the transport state of the domestic appliance. In this regard, the handle clip 310 may experience various loads. For instance, the various loads may be forces applied to the handle clip 310 by the weight of the appliance handle 302 or by the shifting of the appliance handle 302 due to the movement of the domestic appliance in the transport state. The appliance handle 302 may apply loads to the handle clip 310 approximately along the lateral direction W, approximately along the longitudinal direction G, or approximately along the height direction H.

In certain embodiments, the environmental conditions or the load conditions experienced by the handle clip 310 may cause the handle clip 310 to experience component creep. As used herein "component creep" or a "creep condition" may refer to a condition wherein one or more components of the handle clip 310 may twist, or may be torqued, as a result of the environmental conditions or the load conditions applied to the handle clip 310. In some instances, as the handle clip 310 (e.g., at the resilient arc joint 340) experiences thermal relaxation or the load(s) applied by the appliance handle 302, the handle clip 310 may creep in relation to the wire rack 304. For example, the handle clip 310 (e.g., at the resilient arc joint 340) may experience thermal relaxation (e.g., due to the environmental conditions) and may be twisted, or may be torqued, (e.g., due to the load conditions) such that the clamp tab 336 experiences movement (e.g., approximately along the lateral direction W) relative to the rigid tab 334. In some instances, this twisting or torquing of the handle clip 310 may otherwise motivate the handle clip 310 to become detached from the wire rack 304.

Notably, the exemplary handle clip 310 may advantageously prevent or mitigate component creep that the handle clip 310 may otherwise experience during the transport state of the domestic appliance. For instance, the forked lower groove wall 346 of the clamp tab 336 and the gusset 339 of the rigid tab 334 may together function as a mechanical stop that may prevent or mitigate component creep in the transport state of the domestic appliance. Specifically, the forked lower groove wall 346 may include an overlapping portion 356 (see, e.g., FIG. 6) that may overlap, or be positioned adjacent to, the gusset 339. In this regard, the overlapping portion 356 may interface with the gusset 339 when the handle clip 310 experiences a creep condition. As should be appreciated, both lateral sides of the forked lower groove wall 346 may include an overlapping portion 356. In this regard, component creep of the handle clip 310 that may occur in the lateral direction W may be prevented or mitigated.

Embodiments of the present subject matter advantageously provide a mechanical stop feature that is configured to prevent twisting or torquing (e.g., torsional rotation) of the handle clip in the transport state of the domestic appliance. For instance, one or more handle clips are configured to snap on a wire frame such that an appliance handle can be secured to it, e.g., in the transport state. The one or more handle clips support the weight of the appliance handle until the domestic appliance reaches its final destination. During this time, the one or more handle clips can be exposed to various environmental conditions as well as the load of the appliance handle. Due to these various environmental conditions and the load of the appliance handle, the one or more handle clips are susceptible to component creep, e.g., twisting or torsional rotation of the handle clip relative to the wire frame. Accordingly, embodiments of the present subject matter advantageously provide a handle clip with a gusset that can interface with a forked lower groove wall to prevent component creep during the transport state.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A handle clip for securing an appliance handle during shipping, the handle clip comprising:
- a mount segment securable to the appliance handle;
- a support segment extending from the mount segment away from the appliance handle; and
- a connection segment joined to the support segment for receipt on a wire frame, the connection segment comprising:
  - a rigid tab comprising a rigid body, a groove shelf, and a gusset, the rigid body extending downward relative to the support segment, the groove shelf extending from the rigid body away from the support segment, and the gusset provided between the rigid body and the groove shelf;
  - a clamp tab longitudinally spaced apart from the rigid tab, the clamp tab comprising a clamp body and a forked lower groove wall, the clamp body extending downward relative to the support segment, the forked lower groove wall extending from the clamp body toward the rigid tab; and
  - a resilient arc joint extending from the rigid tab to the clamp tab,
  - wherein the clamp tab defines a receiving slot to receive the gusset therethrough,
  - wherein the clamp tab is selectively deflectable relative to the rigid tab, and
  - wherein the connection segment defines a wire groove to receive the wire frame between the rigid tab and the clamp tab.

2. The handle clip of claim 1, wherein the gusset is extended from the rigid body toward the clamp tab.

3. The handle clip of claim 1, wherein the clamp body and the forked lower groove wall define the receiving slot.

4. The handle clip of claim 1, wherein the forked lower groove wall comprises an overlapping portion at a longitudinal end of the forked lower groove wall.

5. The handle clip of claim 4, wherein during a creep condition of the handle clip, the overlapping portion of the forked lower groove wall interfaces with the gusset.

6. The handle clip of claim 1, wherein the clamp tab comprises an upper groove wall disposed above the forked lower groove wall and extending toward the rigid tab, and wherein the groove shelf is disposed vertically between the upper groove wall and the forked lower groove wall.

7. The handle clip of claim 6, wherein the upper groove wall, the forked lower groove wall, and the groove shelf together define the wire groove to receive the wire frame.

8. The handle clip of claim 1, wherein the mount segment comprises an assembly post to be received within a mated cavity of the appliance handle.

9. The handle clip of claim 8, wherein the assembly post extends upward and opposite of the rigid tab.

10. A handle clip for securing an appliance handle during shipping, the handle clip comprising:
- a mount segment securable to the appliance handle;
- a support segment extending from the mount segment away from the appliance handle; and
- a connection segment joined to the support segment for receipt on a wire frame, the connection segment comprising:
  - a rigid tab comprising a rigid body, a groove shelf, and a gusset, the rigid body extending downward relative to the support segment, the groove shelf extending from the rigid body away from the support segment, and the gusset provided between the rigid body and the groove shelf;
  - a clamp tab longitudinally spaced apart from the rigid tab, the clamp tab comprising a clamp body and a forked lower groove wall, the clamp body extending downward relative to the support segment, the forked lower groove wall extending from the clamp body toward the rigid tab; and a resilient arc joint extending from the rigid tab to the clamp tab, wherein the connection segment defines a wire groove to receive the wire frame between the rigid tab and the clamp tab, and wherein the gusset is extended from the rigid body toward the clamp tab.

11. The handle clip of claim 10, wherein the clamp tab defines a receiving slot to receive the gusset therethrough.

12. The handle clip of claim 11, wherein the clamp body and the forked lower groove wall define the receiving slot.

13. The handle clip of claim 10, wherein the clamp tab is selectively deflectable relative to the rigid tab.

14. The handle clip of claim 10, wherein the forked lower groove wall comprises an overlapping portion at a longitudinal end of the forked lower groove wall.

15. The handle clip of claim 14, wherein during a creep condition of the handle clip, the overlapping portion of the forked lower groove wall interfaces with the gusset.

16. The handle clip of claim 10, wherein the clamp tab comprises an upper groove wall disposed above the forked lower groove wall and extending toward the rigid tab, and wherein the groove shelf is disposed vertically between the upper groove wall and the forked lower groove wall.

17. The handle clip of claim 16, wherein the upper groove wall, the forked lower groove wall, and the groove shelf together define the wire groove to receive the wire frame.

18. The handle clip of claim 10, wherein the mount segment comprises an assembly post to be received within a mated cavity of the appliance handle.

19. The handle clip of claim 18, wherein the assembly post extends upward and opposite of the rigid tab.

* * * * *